US012180865B2

(12) United States Patent
Saggam et al.

(10) Patent No.: US 12,180,865 B2
(45) Date of Patent: Dec. 31, 2024

(54) LATCH ASSEMBLY AND VALVETRAIN COMPRISING SAME

(71) Applicant: Eaton Intelligent Power Limited, Dublin (IE)

(72) Inventors: Nikhil Saggam, Pune (IN); Shahnawaz Khan, Pune (IN); Saurabh Patil, Osmanabad (IN); Matthew A. Vance, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/262,153

(22) PCT Filed: Jan. 20, 2022

(86) PCT No.: PCT/EP2022/025020
§ 371 (c)(1),
(2) Date: Jul. 19, 2023

(87) PCT Pub. No.: WO2022/157005
PCT Pub. Date: Jul. 28, 2022

(65) Prior Publication Data

US 2024/0093622 A1 Mar. 21, 2024

(30) Foreign Application Priority Data

Jan. 20, 2021 (IN) ..... 202111002784

(51) Int. Cl.
*F01L 1/46* (2006.01)
*F01L 1/26* (2006.01)
(Continued)

(52) U.S. Cl.
CPC ..... *F01L 1/46* (2013.01); *F01L 1/267* (2013.01); *F01L 13/0015* (2013.01);
(Continued)

(58) Field of Classification Search
CPC ... F01L 1/181; F01L 1/267; F01L 1/46; F01L 13/0015; F01L 2013/0094; F01L 13/06; F01L 13/065; F01L 13/08; F01L 2820/031
(Continued)

(56) References Cited

U.S. PATENT DOCUMENTS

2011/0079196 A1* 4/2011 Kraft ..... F01L 13/06 123/90.46
2011/0120411 A1* 5/2011 Ren ..... F02D 13/0253 123/321
(Continued)

FOREIGN PATENT DOCUMENTS

WO WO-2020088798 A1 * 5/2020 ..... F01L 1/267

OTHER PUBLICATIONS

International Search Report and Written Opinion for International Application No. PCT/EP2022/025020 mailed on May 10, 2022, 9 pages, May 10, 2022.

*Primary Examiner* — Jorge L Leon, Jr.
(74) *Attorney, Agent, or Firm* — Baker Botts L.L.P.

(57) ABSTRACT

A latch assembly and valvetrain therewith can comprise a stationary housing comprising a plunger cavity, a plunger in the plunger cavity, and a controllable upper latch member. The plunger can comprise a control end, a plunger body, a spigot body and a spigot end. The controllable upper latch member can be configured to selectively act on the control end and can be configured to switch between locking the plunger from moving along a first axis and unlocking the plunger to slide in the plunger cavity along the first axis. A slidable transverse latch member or rotatable upper castellation body can act as the controllable upper latch member. While a valve bridge and rocker arm can be movable, the housing for the latch assembly can be stationary.

15 Claims, 6 Drawing Sheets

(51) Int. Cl.

| | |
|---|---|
| ***F01L 13/00*** | (2006.01) |
| ***F01L 13/06*** | (2006.01) |
| ***F01L 13/08*** | (2006.01) |
| *F01L 1/18* | (2006.01) |

(52) U.S. Cl.
CPC ..... *F01L 13/06* (2013.01); *F01L 13/065* (2013.01); *F01L 13/08* (2013.01); *F01L 1/181* (2013.01); *F01L 2013/0094* (2013.01); *F01L 2820/031* (2013.01)

(58) Field of Classification Search
USPC ..... 123/90.4
See application file for complete search history.

(56) References Cited

U.S. PATENT DOCUMENTS

| | | | | |
|---|---|---|---|---|
| 2013/0068195 | A1* | 3/2013 | Ruggiero | F01L 13/06 123/321 |
| 2018/0187579 | A1* | 7/2018 | Cecur | F01L 1/18 |
| 2019/0309664 | A1* | 10/2019 | Batcheller | F01L 1/181 |
| 2020/0325803 | A1 | 10/2020 | Patil | |
| 2021/0131318 | A1* | 5/2021 | Vanwingerden | F01L 1/047 |
| 2021/0156319 | A1* | 5/2021 | Stec | F02D 13/04 |

* cited by examiner

LATCH ASSEMBLY AND VALVETRAIN COMPRISING SAME

PRIORITY

This application claims the benefit under 35 U.S.C. § 371 of International Patent Application No. PCT/EP2022/025020, filed 20 Jan. 2022,which claims the benefit under 35 U.S.C. § 119 (a) of Indian Provisional Patent Application No. 202111002784, filed 20 Jan. 2021, all of which are incorporated herein by reference.

FIELD

This application provides a latch assembly and valvetrain therewith. The latch assembly can be installed over a valve bridge for acting on a valve stem end directly or indirectly through a valve bridge cleat.

BACKGROUND

Fuel savings and energy efficiency continue to be key goals in combustion machinery. Variable valve actuation is one option to achieve these goals. But, packaging, critical shifts, and actuator installations continue to be design constraints.

SUMMARY

The methods disclosed herein overcome the above disadvantages and improves the art by way of a valvetrain comprising a latch assembly. The latch assembly can be formed as a capsule that can be installed on a valvetrain and can be stationary on the cylinder head. Methods for performing decompression engine braking can be devised. And, the latch assembly, while explained herein as a decompression engine brake, can be used for other types of variable valve actuation, such as early or late valve opening or closing events, internal exhaust gas recirculation, or negative valve overlap, among other options.

A latch assembly and valvetrain therewith can comprise a stationary housing comprising a plunger cavity, a plunger in the plunger cavity, and a controllable upper latch member. The plunger can comprise a control end, a plunger body, a spigot body and a spigot end. The controllable upper latch member can be configured to selectively act on the control end and can be configured to switch between locking the plunger from moving along a first axis and unlocking the plunger to slide in the plunger cavity along the first axis. A slidable transverse latch member or rotatable upper castellation body can act as the controllable upper latch member. While a valve bridge and rocker arm can be movable, the housing for the latch assembly can be stationary.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

The disclosed valvetrain assemblies 5, 6, 7 enable reduced starting torque and shutdown shake. Latch assemblies 30, 31, 32 enable at least a bleeder brake system as a working example, though other valve control techniques such as early opening or late closing can be substituted. Exemplary implementation is shown in a Type V pushrod style diesel engine.

Figure 1:
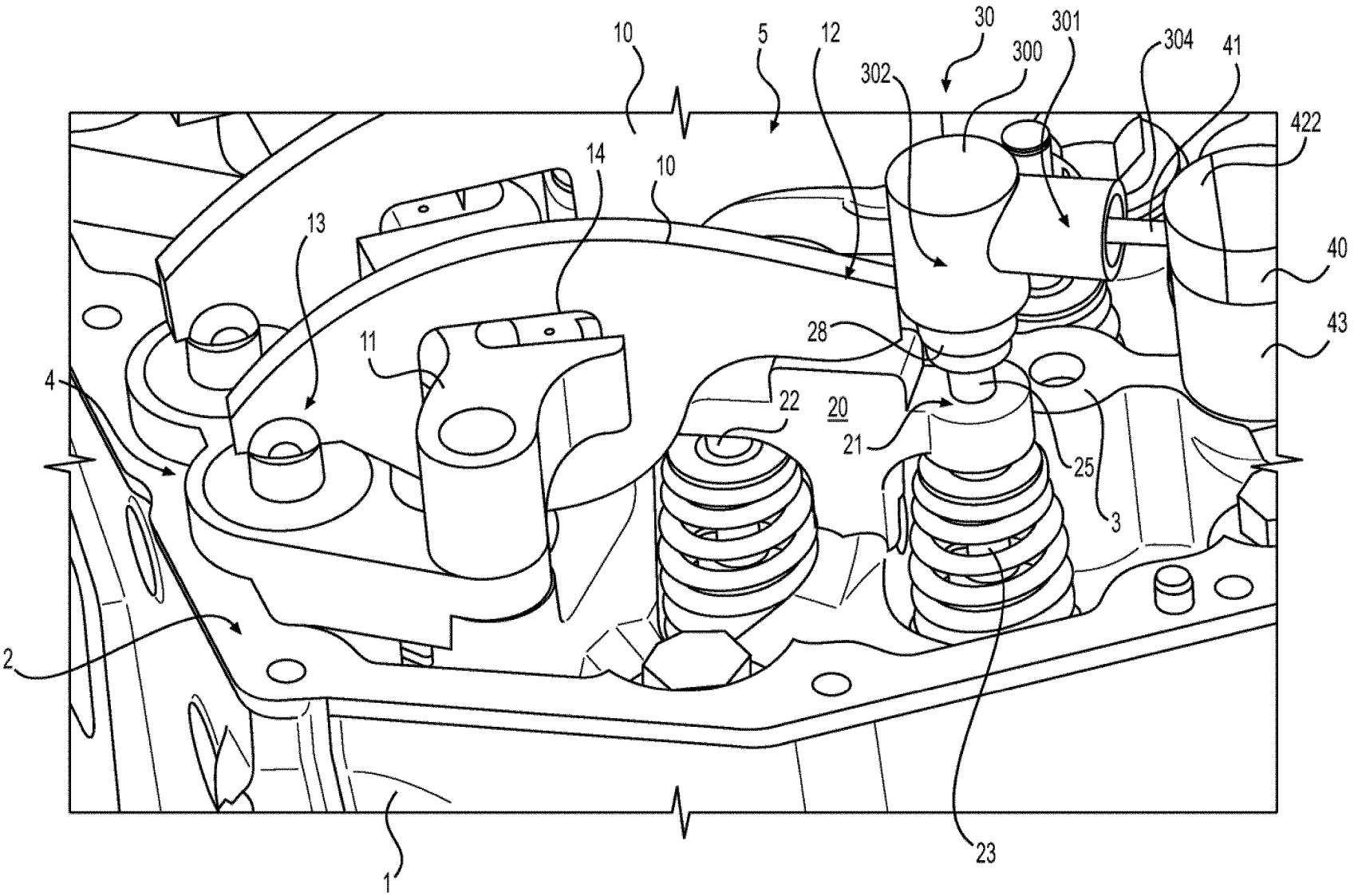
FIG. 1 is a view of a valvetrain on a cylinder head of an engine block. A latch assembly is installed.

FIG. 1 shows a portion of the engine block 1. The cylinder head 2 comprises mounting areas 3 for various components such as tower 4, rocker arms 10, rocker tower 11, valves and their biasing members. Valvetrain assemblies 5-7 herein are shown with a first valve 22 and an auxiliary valve 23. A pushrod system can actuate on pivot ends 13 so that rocker arms 10 rotate about rocker tower 11 in rocker ports 14. Valve ends 12 can push down on respective valve bridge 20. In this example, first valve 22 is coupled to a first end of valve bridge 20 and auxiliary valve 23 is coupled in a bridge pass-through 21. Valve end 12 presses on a seating area of the valve bridge. Auxiliary valve 23 can comprise a stem end 231 that can be received in a valve grip 26 of cleat 25. An actuation end 27 of the cleat 25 can interface directly or indirectly through an elephant foot (e-foot) 28 with the latch assembly 30, 31, 32. Alternatively, the stem end 231 can be integrally formed to comprise the outer shape and function of the cleat 25.

FIG. 1 shows a valvetrain assembly 5 that is light weighted by its plate or sheet style rocker arms 10. Even with this space and weight savings, the cylinder head 2 is still crowded. So while prior art systems could use a third rocker arm to perform an auxiliary function on the valve bridge 20, the latch assemblies 30-32 are instead used. This avoids a pushrod system & connection to rocker tower 11, among other benefits like reduced weight and reduced material use. The controller 40 and actuator 422 can comprise little or less weight relative to adding another rocker arm for an auxiliary function like decompression engine braking.

Figure 2B:
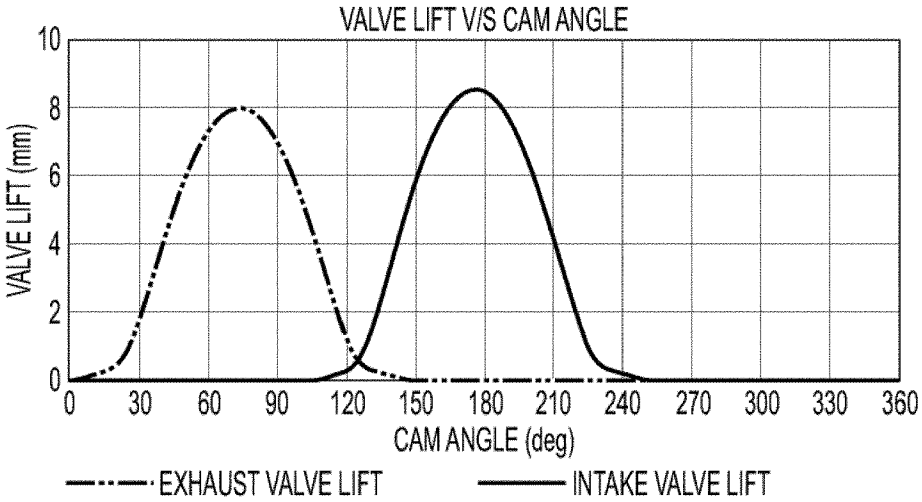
FIG. 2B shows an exemplary valve lift for a valvetrain comprising the unlatched latch assembly.
Figure 4B:
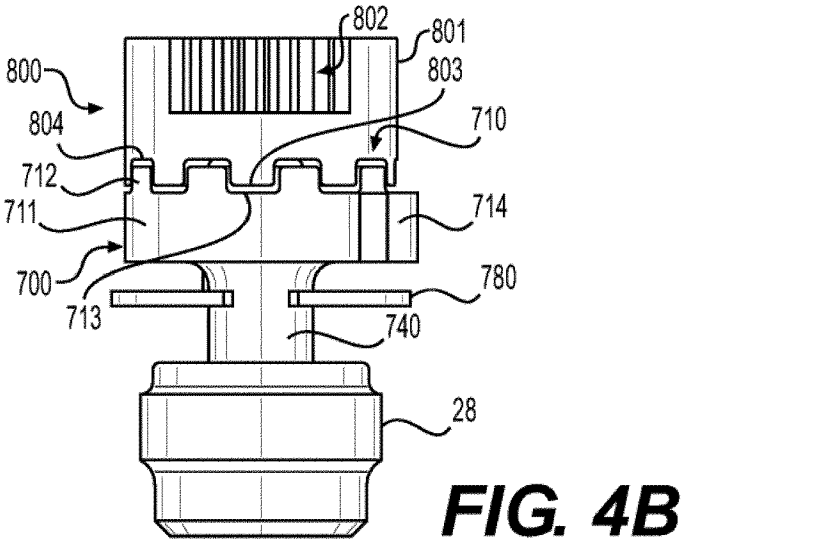
FIGS. 4A-4C show an alternative unlatched latch assembly and valve lifts.
Figure 4C:
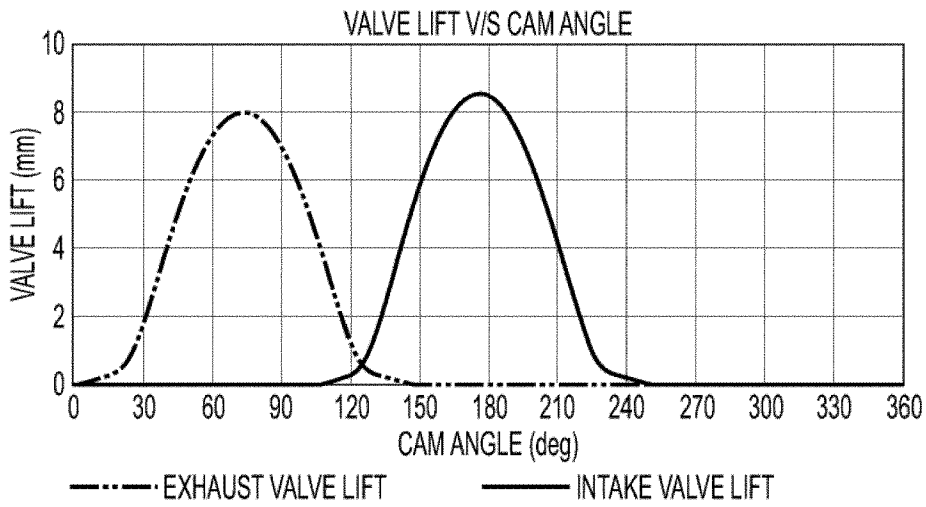
Figure 4A:
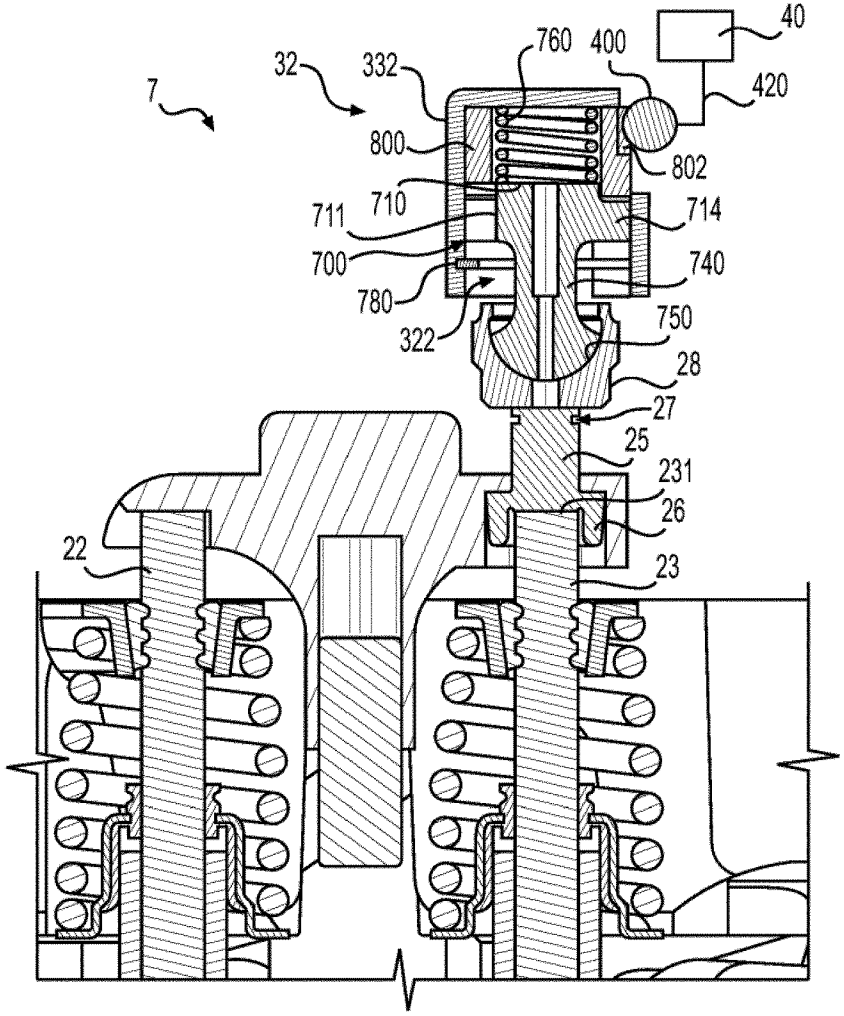
Figure 5B:
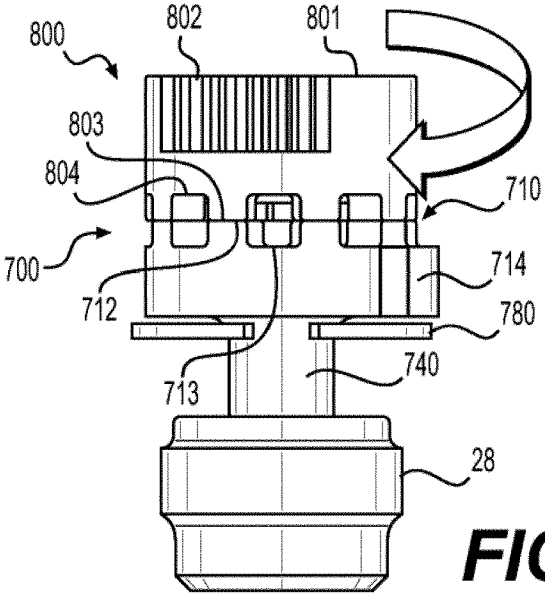
FIGS. 5A-5C show an alternative latched latch assembly and valve lifts.
Figure 5C:
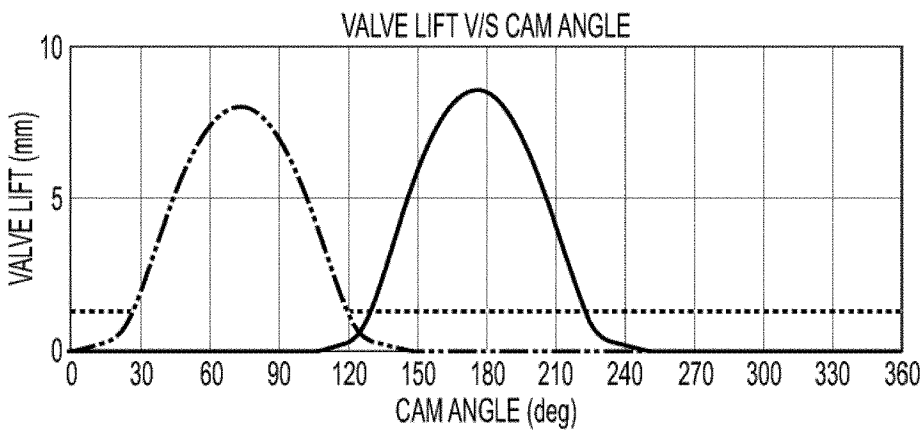

In a first aspect, a latchable decompression mechanism in the form of latch assembly 30 is designed to achieve extra lift (OB Valve-Decomp, FIG. 3B) of around 1~2 mm throughout 360 degrees of camshaft rotation over and above the standard valve lift (FIG. 2B) to allow compressed gases to escape. Nominal exhaust and intake valve lift is shown in FIGS. 2B & 4C. The rocker arm 10 motion on the valve bridge 20 can achieve this. But, in FIGS. 3B & 5C, one of the exhaust valves (first valve 22) and the intake valves can follow the nominal valve lift, but the auxiliary valve 23, under the action of the latch assembly 30-32, is held open despite the motion of the rocker arm 10 against the valve bridge 20. A gap G is shown between the valve bridge 20 and the cleat 25 which is indicative of the OB Valve-DECOMP lift line. This reduces the compression efforts during start-up and shut-down which results in reduced starting torque, suppressed shut down shake, and also can be used to achieve engine braking functionality during operational modes. Many of the examples can be biased to the latched position as a default state so that a powerless or low power start-up or shut-down condition readily enters the auxiliary mode. Or, to save power during the operational mode, the latch assemblies 30-32 can be biased to the unlatched position so that no power is needed during the operational modes until the auxiliary mode is desired. The drawings show the transverse latch member 60 variants biased unlatched, with power required to overcome the latch spring 66. But, such bias can be reversed. Likewise, the plunger body 711 comprising a castellation body can be biased to a latched (FIG. 5B) or unlatched (FIG. 4B) starting position.

While a single exhaust valve is shown being actuated, it is possible to move the latch assembly 30-32 from the outboard valve to the inboard valve, or to move the latch assembly 30-32 to actuate on both of the valves, as by adjusting the contact point of the latch assembly against the valve bridge 20.

A light weight housing 300, 331, 332 can be installed on the cylinder head 2 thereby making it a stationary housing relative to the other moving parts (rocker arms 10, valve bridge 20, first and auxiliary valves 22, 23). Actuator 422 can be any one of several different mechanisms, such as mechanical, electromechanical, electromagnetic, hydraulic or other actuation. Actuator 422 can be linked to a controller 40. Controller 40 an be an integrated circuit, computer, electronic control unit (ECU), among many other options. Controller 40 can issue commands to the actuator 422. For example, a linear motor or worm gear drive can drive latch coupler 41. Latch coupler 41 can be, for example, a piston or other linkage mounted to the latch member 60. A controller mount 43 can be installed on the cylinder head 2. Controller mount 43 can comprise a cover or other housing or a tower or other mounting structure. Or, a line from a remote location can be routed to the actuator 422. Controller 40 can be at or near the main electronic control unit, while the actuator 422 is at the engine block 1. Such is true for the other examples, where, for example, an oil control valve (OCV) 401 can be remote from the oil supply line 421 to the latch bore 62.

Figure 2A:
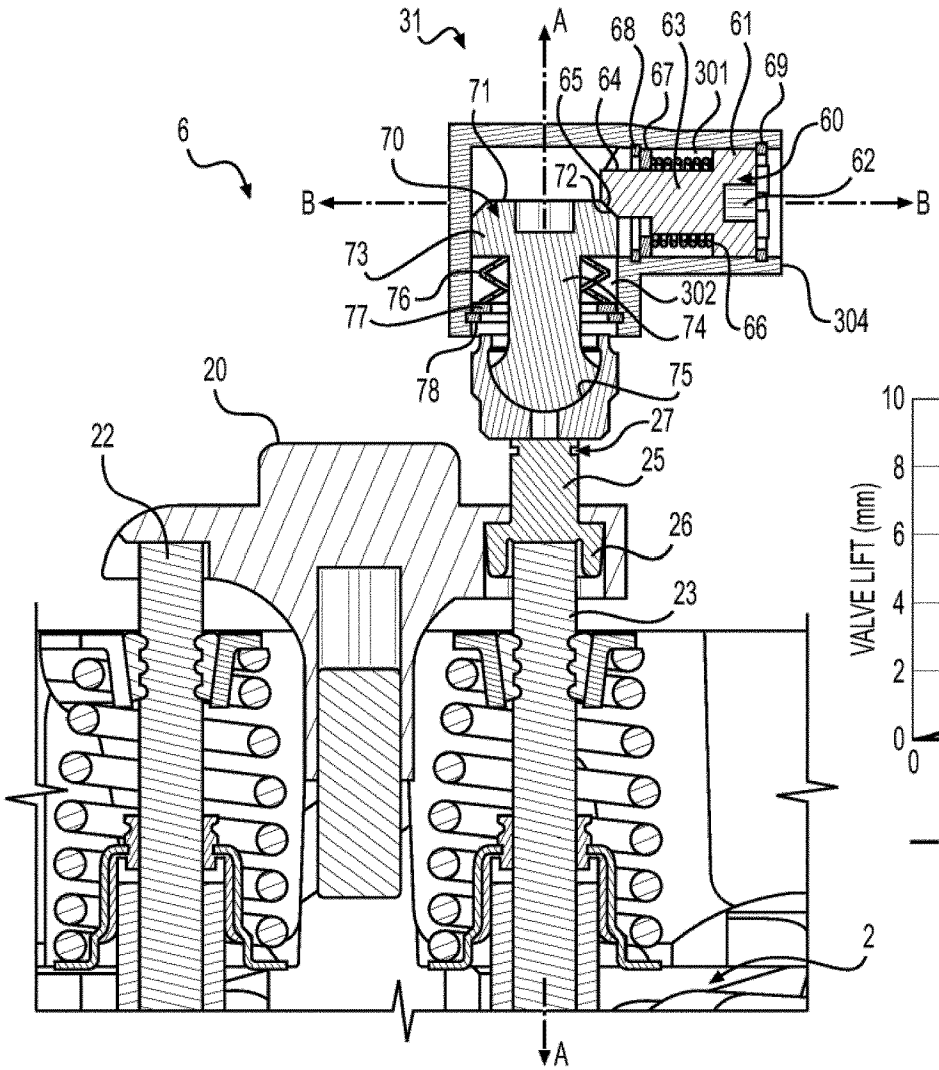
FIG. 2A is a view of an unlatched latch assembly.
Figures 3A, 3B:
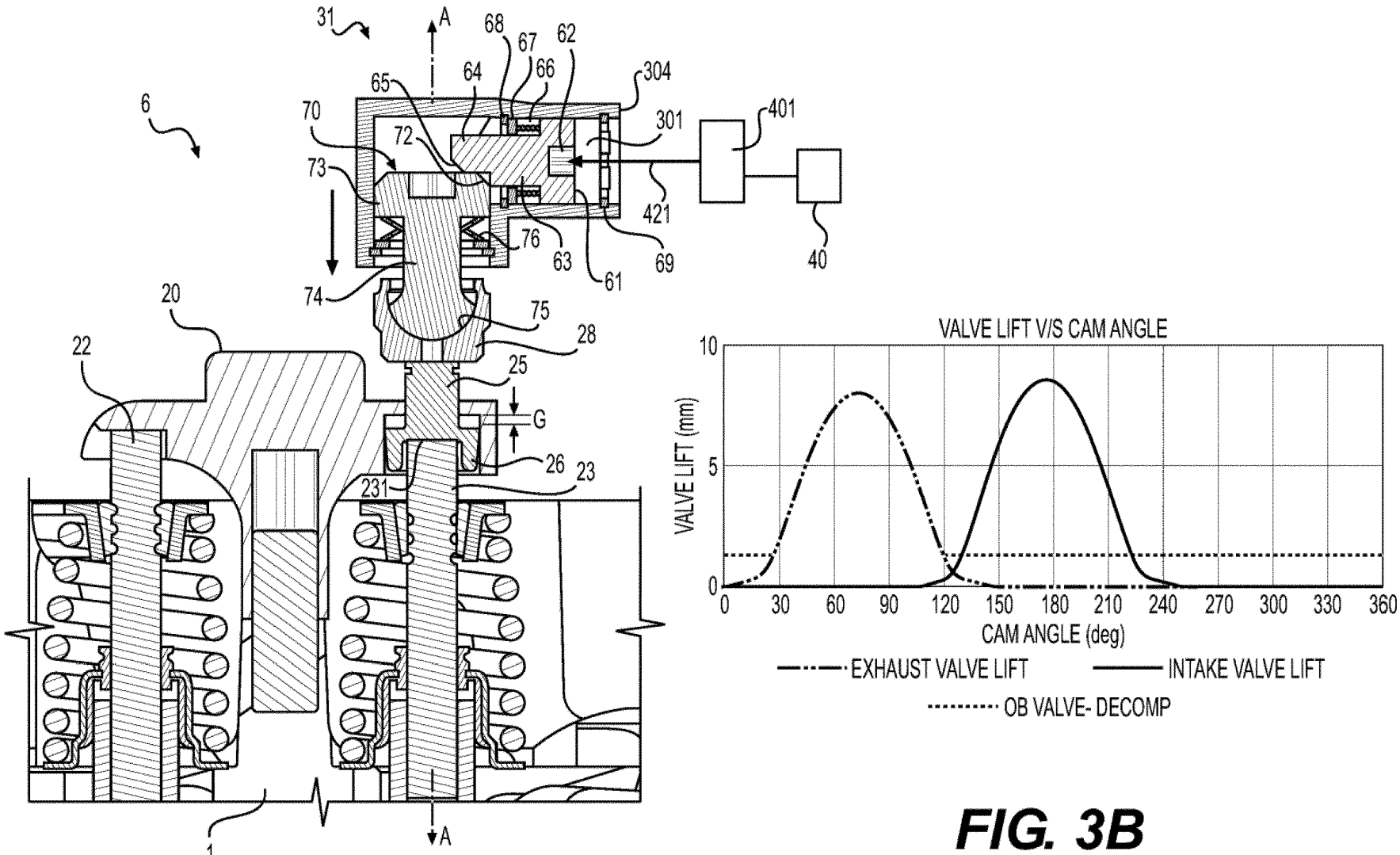
FIG. 3A is a view of a latched latch assembly.
FIG. 3B shows a exemplary valve lifts for a valvetrain comprising the latched latch assembly.
Figure 6:
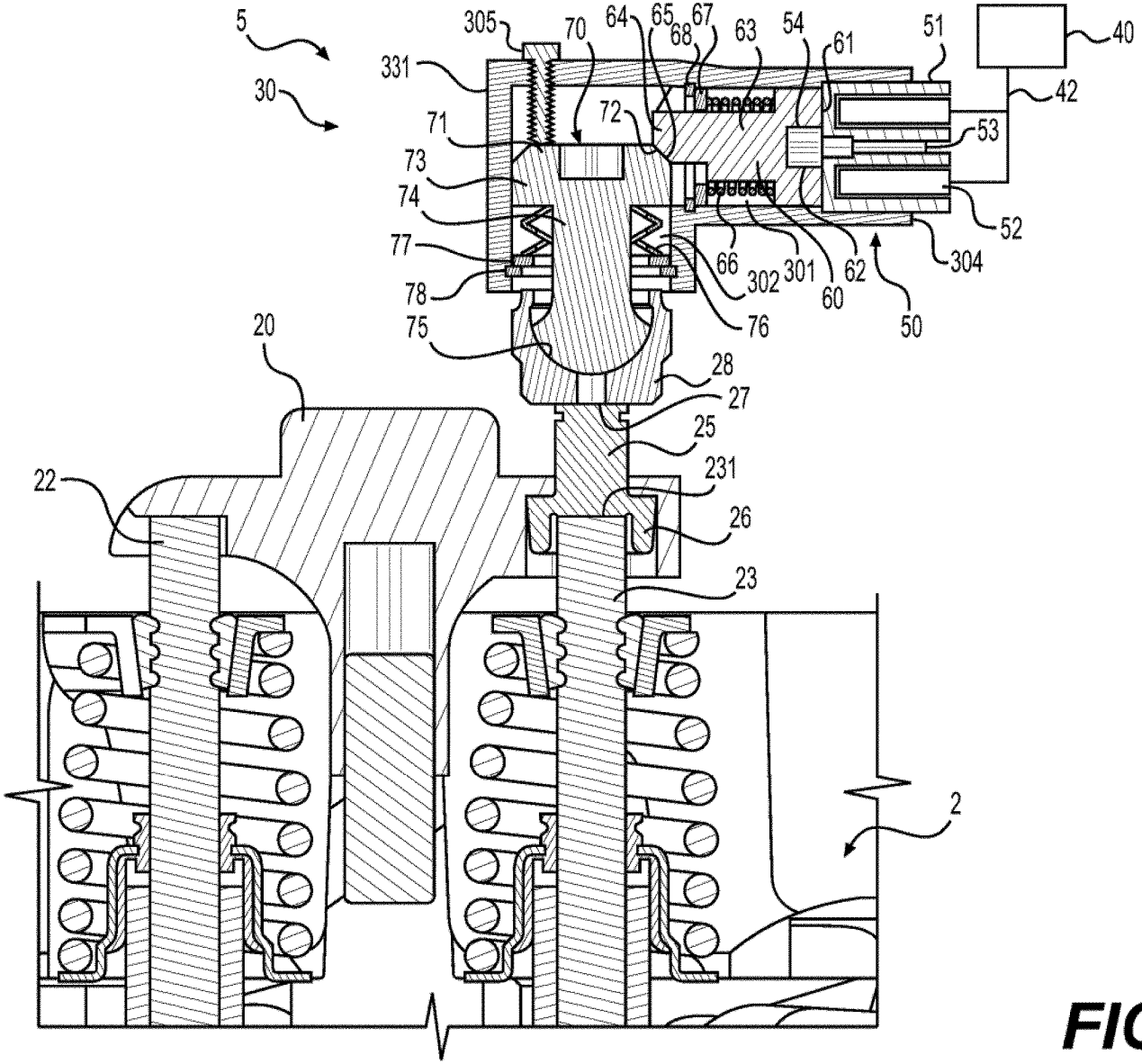
FIG. 6 shows another alternative unlatched latch assembly.

Turning to FIGS. 2A, 3A, & 6, a housing 300 for latch assembly 30 can comprise a latch cavity 301 along an axis B-B that is transverse to a plunger cavity 302 along axis A-A. Latch member 60 and plunger 70 are incorporated within the housing 300. A plunger spring 76 can bias against a guide body 77 such as a washer, bushing, step, or lip. Alternatively or additionally, a securement 78 such as a bushing, snap ring or the like can be placed in a groove of the plunger cavity 302. Stacking one or more guide bodies 77 can set the starting height for the plunger 70. Guide body 77 can also guide the spigot body so that spigot end 75 is placed relative to the auxiliary valve 23 and a controlled motion of the plunger 70 can be achieved. A bore can be included in the plunger 70 for purposes such as handling or light weighting. As another option, control end 71 can interface with a lash screw 305. Lash screw 305 can be a pin, screw or bolt or the like that can be pushed or screwed through housing 300 to set the location of plunger 70 as either a travel limit or mechanical lash adjuster. Plunger body 73 is positioned in plunger cavity 302 to slide therein. When latch member 60 acts on plunger 70, the spigot end 75 can move towards the valve stem end 231 to form gap G. A chamfer 72 can be included on the control end 71 to help the latch nose 64 act on the plunger 70.

Likewise, latch nose 64 can comprise a latch chamfer 65. Latch nose 64 can be guided in latch cavity 301 for a controlled linear motion by a latch guide 67 which can likewise be a bushing, washer, step, lip, or the like. An additional or optional latch securement 68 such as a bushing or snap ring or the like can be included. A latch spring 66 is biased against the latch guide 67 or latch securement 68 to bias the latch member 60 to the unlatched position (FIGS. 2A & 6). The latch member 60 will be at its initial position as shown in FIG. 2A and there is no force on plunger 70, so there is no auxiliary valve lift on valve 23.

But, if a supply pressure, such as hydraulic control to oil supply line 421, occurs, or such as solenoid control to piston 53, the latch member 60 will slide in latch cavity 301 to push plunger 70 and latch in a latched position (FIG. 3A). A control end 61 of latch body 63 can comprise a latch bore 62 for receiving hydraulic control or for receiving a piston head 54. Latch body 63 can slide against latch cavity 301 to control against latch wobble. For oil control, an oil seal 69 can be included in the latch cavity 301. Oil seal 69 can also or alternatively serve as a travel limit. In FIG. 6, a solenoid 50 is integrated with the latch cavity 301. Solenoid 50 is pressed past a brim 304 of the latch cavity 301. Another housing portion can be joined at the brim 304 in this example or the example of FIG. 1. A spool 51 seats windings 52 relative to the piston 53. Leads 42 power the windings 52 at the command of controller 40, which can comprise a power supply.

As plunger 70 goes in an exhaust stroke (bold arrow in FIG. 3A), force from actuator (OCV 401, solenoid 50, or other Electro-Mechanical or hydraulic or pneumatic control) is exerted on latch member 60, which causes linear movement of latch member 60 by compressing latch spring 66. Plunger spring 76 can also be compressed. When actuator force is removed, the latch member 60 and plunger 70 can return to the unlatched position by the force of their respective latch spring 66 and plunger spring 76. Alternatively, the force of the valve spring of auxiliary valve 23 can bias the plunger 70 to its unlatched position when the actuator force is removed.

But, when latched, due to forward linear movement of latch member 60, plunger 70 can't move to its original unlatched position. This creates and maintains gap G. Gap G is a clearance between the valve bridge pass-through 21, also called a socket and the cleat 25 or valve stem end seated in the valve bridge 20. This clearance is 'valve lift', and due to this lift decompression can be achieved.

Due to the wedge (latch chamfer 65) on the latch member 60, the latch member 60 forces downward motion of the plunger 70 thereby compressing the plunger spring 76. The downward travel of the plunger 70 can be changed by changing the design of the wedge (plunger chamfer 72) on the plunger 70 and or by changing the design of the wedge (latch chamfer 65) on the latch member 60.

Once the first and auxiliary valves 22, 23 come towards the end of the exhaust stroke, the outboard valve would be kept open by the plunger 70 through the latch assembly 30-32. The cleat 25 can guide the auxiliary valve 23 on the outboard side of the valve bridge 20. The downward travel of the plunger 70 transfers the additional valve lift achieved during the latched condition.

To go back to nominal drive mode, the controller 40 would switch the corresponding actuator OFF, the latch spring 66 would push the latch member 60 towards the actuator. The plunger 70 would then be forced upwards by the plunger spring force. This deactivation could take place during the exhaust stroke.

In a third aspect lower and upper crowns of a castellation assembly are incorporated in the housing 332. Housing 332 can comprise a castellation lid 333 and plunger cavity 302. In lieu of a latch cavity, an opening is formed to couple to an actuator such as a castellation wheel 400. A controller 40 can be coupled by a lead 420 to the castellation wheel 400. Castellation wheel 400 can comprise one of a number of devices, such as a worm gear or toothed plunger for rack-and pinion style actuation against control teeth 802.

Housing 332 can comprise a step or slot portion to receive a rotation key 714. Plunger 700 can slide in the plunger cavity 322 but cannot rotate when the rotation key 714 is guided in the step or slot of the housing 332.

Figure 5A:
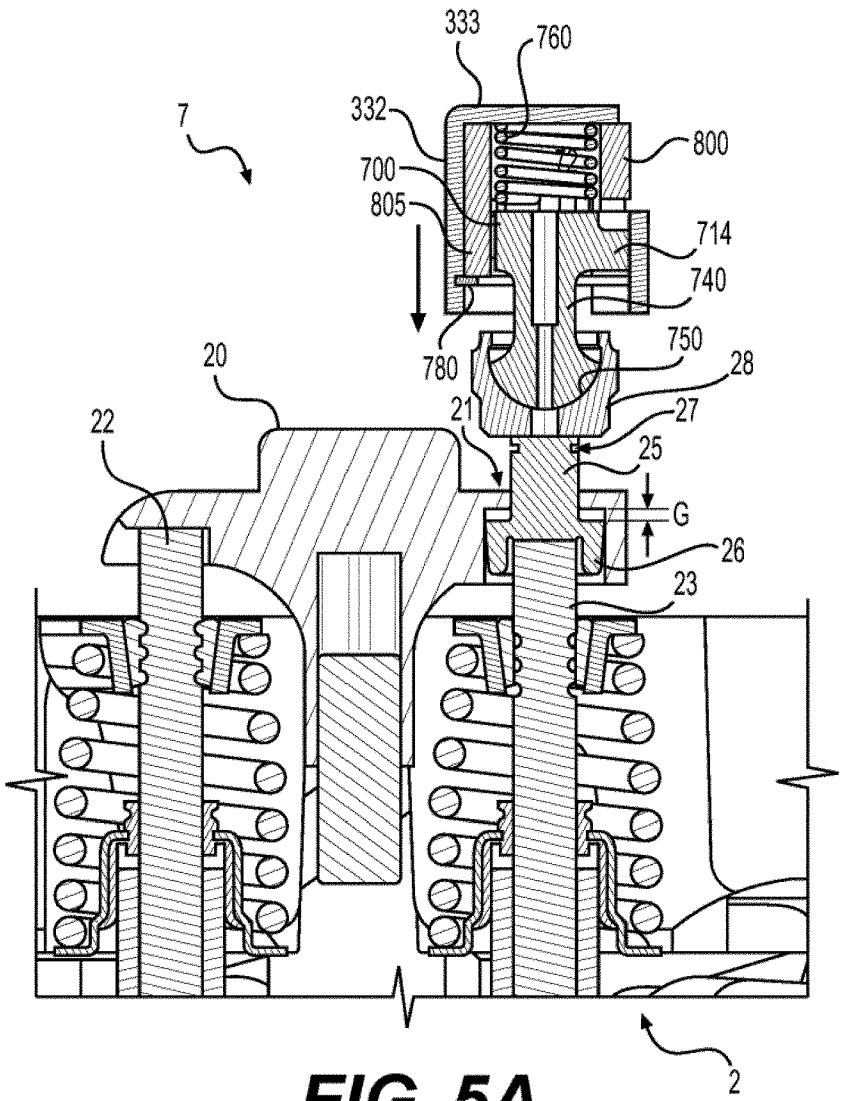

Plunger spring 760 pushes against the castellation lid 333 and the control end 710 of the plunger 700. The plunger body 711 (also called a castellation body) comprising the lower crown is pushed in the downward direction (bold arrow in FIG. 5A). A securement 780 such as a washer or snap ring keeps the lower crown from falling out of the housing 332.

During drive mode (FIG. 4B), on the base circle, the plunger spring 760 pushes the plunger 700 comprising lower crown against the cleat 25 resting on the outboard (auxiliary) valve 23. But, being unlatched, the castellation teeth 712 in plunger body 711 can collapse into upper castellation teeth 803 in upper castellation body 801 in latch member 800. A positioning leg 805 of the latch member 800 can serve as a travel limit against the securement 780. Spigot body 740 attached to spigot end 750 can slide in plunger cavity 322 away from valve bridge 20 when the valve springs of auxiliary valve 23 press the valve stem end 231 upwards.

But, when the latch assembly 32 is locked (FIG. 5B), as by control from castellation wheel 400, the upper castellation teeth 803 can be rotated so that the upper castellation gaps 804 no longer align with the castellation teeth 712. Now, plunger gaps 713 align with upper castellation gaps 804 and upper castellation teeth 803 align with plunger castellation teeth 712. The control end 710 of plunger 700 is locked against the upper castellation formed by latch member 800. The auxiliary valve lift can be achieved as in other examples.

To switch the latch assembly 32 back to drive mode, the controller 40 can direct the actuator to switch OFF. The castellation wheel 400 can move oppositely, or a bias arrangement can be released. Then, the upper crown in latch member 800 rotates and now again the upper castellation teeth 803 on upper crown are aligned with plunger gaps 713 on the plunger body 711 of the lower crown. The plunger 700 can collapse into the upper castellation of latch member 800. Plunger spring 760 can be compressed instead of keeping the outboard (auxiliary) valve 23 open and no additional valve lift is achieved.

Rocker arm systems, valvetrain systems, rocker arms, and valve actuating assemblies can comprise alternative castellation mechanisms and alternative actuators to those shown in the Figures. It is possible to substitute other castellation mechanisms or their actuators for those shown herein, such as those described in, for example, WO2021/1164949, WO2021/1164948, WO2019/133658, WO2019/036272, US2020/0325803, US2018/0187579, U.S. Pat. Nos. 4,227,494, 6,354,265, 6,273,039, & U.S. Pat. No. 4,200,081. The latch assemblies 30, 31, 32 disclosed herein can be used in rocker arm systems, valvetrain systems, rocker arms, and valve actuating assemblies such as those disclosed in these same exemplary publications. The latch assemblies 30, 31, 32 herein can be used in other systems where switchable mechanisms are employed.

It can be said that a latch assembly 30-32 can comprise a stationary housing 300, 331, 332. A plunger 70, 700 can be in a plunger cavity 302, 322. The plunger 70, 700 can comprise a control end 710, 710, a plunger body 73, 711, a spigot body 74, 740 and a spigot end 75, 750. A controllable upper latch member 60, 800 can be configured to selectively act on the control end 71, 710. The controllable upper latch member 60, 800 can be configured to switch between locking the plunger 70, 700 from moving along a first axis A-A and unlocking the plunger 70, 700 to slide in the plunger cavity 302, 322 along the first axis A-A.

The stationary housing 300, 331, can comprise a latch cavity 301 transverse to the plunger cavity 302. The controllable upper latch member comprises a latch member 60 slidable along the latch cavity 301.

The latch assembly can comprise a lash screw 305 installed through the stationary housing 331. Lash screw 305 can be configured to press on the control end 71.

The control end 71 can comprise a plunger chamfer 72 configured to interface with the latch member 60. The latch member 60 can comprise a latch chamfer 65 configured to slide across the plunger chamfer 72.

The latch member 60 can comprises a latch body 63 aligned to slide against the latch cavity 301. A latch guide 67 can be configured in the latch cavity 301. The latch member 60 can comprise a latch nose 64 configured to slide on the latch guide 67. Further the control end 61 can comprise a latch bore 62.

The latch assembly 30 can comprise a solenoid assembly 50 installed in the latch cavity 301. A piston 53 of the solenoid assembly 50 can be installed in the latch bore 62. Alternatively, the latch assembly 31 can comprise an oil seal 69 in the latch cavity 301.

The control end 710 can alternatively comprise castellation teeth 712 extending from a lower castellation body formed by plunger body 711. Controllable upper latch member can then comprise a rotatable upper castellation body 801 as part of an upper castellation 800. A castellation wheel 400 can be configured to rotate the upper castellation body 801.

A valvetrain assembly 5, 6, 7, can comprise a valve bridge 20 configured to act on at least one valve 22, 23. The valve bridge 20 can comprise a pass-through 21 for a valve stem end 231. At least one rocker arm 10 can be configured to act on the valve bridge 20. A latch assembly 30, 31, 32 can be configured to act directly or indirectly on the valve stem end 231.

Other implementations will be apparent to those skilled in the art from consideration of the specification and practice of the examples disclosed herein.

What is claimed is:

1. A latch assembly, comprising:

a stationary housing including a plunger cavity and a latch cavity;

a plunger arranged in the plunger cavity, the plunger including a plunger control end, a plunger body, a spigot body, and a spigot end;

a controllable upper latch member arranged in the latch cavity so as to engage the plunger control end, the controllable upper latch member configured to be selectively switched between:

a first position in which the controllable upper latch member maintains the plunger extended out of the plunger cavity, and a second position in which the controllable upper latch member enables the plunger to retract into the plunger cavity; and an actuator at least partially received by a latch bore arranged at a latch control end of the controllable upper latch member, the actuator being electrically, electro-mechanically, or pneumatically controlled.

2. The latch assembly of claim 1, wherein the latch cavity extends transversely to the plunger cavity, and wherein the controllable upper latch member further includes a latch body configured to slide along the latch cavity.

3. The latch assembly of claim 2, wherein the plunger control end includes a plunger chamfer configured to interface with the latch body.

4. The latch assembly of claim 3, wherein the latch body includes a latch chamfer configured to slide across the plunger chamfer.

5. The latch assembly of claim 2, further comprising a latch guide arranged in the latch cavity, and wherein the latch body includes a latch nose configured to slide on the latch guide.

6. The latch assembly of claim 2, further comprising an oil seal arranged in the latch cavity.

7. The latch assembly of claim 1, further comprising a lash screw installed through the stationary housing, the lash screw configured to press on the plunger control end.

8. The latch assembly of claim 1, wherein the actuator is a solenoid assembly.

9. The latch assembly of claim 1, wherein the plunger cavity extends along a first axis, and wherein the latch cavity extends along a second axis transverse to the first axis.

10. The latch assembly of claim 1, further comprising a plunger spring coupled to the plunger, the plunger spring configured to bias the plunger to retract into the plunger cavity.

11. The latch assembly of claim 1, further comprising a latch spring coupled to the controllable upper latch member, the latch spring configured to bias the controllable upper latch member to the second position.

12. The latch assembly of claim 1, wherein the actuator includes a piston that is received by the latch bore.

13. The latch assembly of claim 1, wherein the stationary housing is configured to be installed on a cylinder head.

14. A valvetrain assembly, comprising:

a valve bridge configured to act on at least one valve, the valve bridge including a pass-through configured to receive a valve end of the at least one valve;

at least one rocker arm configured to act on the valve bridge; and a latch assembly configured to act on the valve end, the latch assembly comprising:

a stationary housing including a plunger cavity and a latch cavity;

a plunger arranged in the plunger cavity, the plunger including a plunger control end, a plunger body, a spigot body, and a spigot end;

a controllable upper latch member configured to selectively act on arranged in the latch cavity so as to engage the plunger control end, the controllable upper latch member configured to be selectively switched between:

a first position in which the controllable upper latch member maintains the plunger extended out of the plunger cavity, and a second position in which the controllable upper latch member enables the plunger to retract into the plunger cavity; and an actuator at least partially received by a latch bore arranged at a latch control end of the controllable upper latch member, the actuator being electrically, electro-mechanically, or pneumatically controlled.

15. The valvetrain assembly of claim 14, wherein the plunger control end includes a plunger chamfer, and wherein the controllable upper latch member includes a latch body configured to slide along the latch cavity.

* * * * *